US005809920A

United States Patent [19]

Zantopp et al.

[11] Patent Number: 5,809,920

[45] Date of Patent: Sep. 22, 1998

[54] FOLDING DEVICE FOR AN AUTOMATIC SEWING MACHINE

[75] Inventors: Juergen Zantopp, Mackenbach; Axel Zinssmeister, Rothselberg, both of Germany

[73] Assignee: G.M. Pfaff AG, Kaiserslautern, Germany

[21] Appl. No.: 954,501

[22] Filed: Oct. 20, 1997

[30] Foreign Application Priority Data

Jun. 2, 1997 [DE] Germany ..... 297 09 523.4

[51] Int. Cl.[6] ..... D05B 39/00

[52] U.S. Cl. ..... 112/470.16; 112/147; 223/38

[58] Field of Search ..... 112/153, 147, 112/149, 470.16, 470.14, 470.09, 470.07, 475.06; 223/37, 38

[56] References Cited

U.S. PATENT DOCUMENTS

| | | | |
|---|---|---|---|
| 1,517,493 | 12/1924 | Cluett | 223/38 |
| 3,774,558 | 11/1973 | Scholl et al. | 112/470.09 |
| 4,445,631 | 5/1984 | Del Castillo-Olivares | 112/470.16 X |
| 4,719,863 | 1/1988 | Bisson | 112/470.07 |
| 5,611,468 | 3/1997 | Schulze et al. | 112/470.16 X |

*Primary Examiner*—Ismael Izaguirre
*Attorney, Agent, or Firm*—McGlew and Tuttle

[57] ABSTRACT

A folding device is provided for an automatic sewing machine for folding over at least two edge strips of a first fabric part. The edge strips extend at an angle to one another and the first fabric part will be sewn on a second fabric part. The device includes a support plate for the second fabric part, a folding plate movable in relation to the support plate for the first fabric part, and a carrier plate. The carrier plate is movable in relation to the support plate and the folding plate for a pressing plate that can be placed on the first fabric part. At least two folding slides are provided which are arranged at an angle in relation to one another and which are connected to a drive means each. The folding plate and the pressing plate have at least one edge strip each, whose angle is adjustable, and the angle of at least one of the folding slides is adjustable.

7 Claims, 3 Drawing Sheets

FOLDING DEVICE FOR AN AUTOMATIC SEWING MACHINE

FIELD OF THE INVENTION

The present invention pertains to a folding device for folding over at least two edge strips of a first fabric part, which will be sewn onto a second fabric part wherein the edge strips extend at an angle to one another and the first fabric part will be sewn on a second fabric part, with a support plate for the second fabric part, a folding plate movable in relation to the support plate for the first fabric part, and a carrier plate movable in relation to the support plate and the folding plate for a pressing plate that can be placed on the first fabric part, and at least two folding slides, which are arranged at an angle in relation to one another and which are connected to a drive means each.

BACKGROUND OF THE INVENTION

In manufacturing blue jeans, facings are folded over on two sides in the edge area, which is also called folding over, and are subsequently sewn onto a pocket bag. It has been known that it is possible to use for this purpose folding devices which have a support plate for the pocket bag spread out flat, a folding plate for the facing, which is movable in the vertical and horizontal directions in relation thereto, and a carrier plate, which can be moved up and down and at which a pressing plate as well as two folding slides are arranged, which can be moved to and fro in the horizontal plane by a compressed air cylinder each.

The folding over of the edge strips takes place such that the carrier plate is lowered after the facing has been laid on the folding plate floating at a spaced location above the support plate, as a result of which the pressing plate comes into contact with and presses it against the folding plate. Folding strips, which are fastened to the edge of the pressing plate and project over its underside, now press the edge strips of the facing projecting over the folding plate downwards on two sides, after which the two folding slides fold the prefolded edge strips completely over the narrow side of the folding plate to its underside. By raising the support plate or by lowering the folding plate and the carrier plate together, the folded-over edge strips are then clamped between the folding plate and the support plate, after which the carrier plate is lifted off from the facing to the extent that a sewing template guided by a feed means can be lowered onto the facing. The folding plate is subsequently pulled laterally out of the folded facing, after which the feed means moves the workpiece comprising the pocket bag and the facing to the sewing machine.

The angle between the two folded-over edge strips of the facing and consequently between the two seams of the facing may vary from one jeans shape to the next. If a number of jeans of another shape, which have facings of a different shape, i.e., facings with facing seams extending at a different angle, are to be sewn after sewing a number of jeans of one shape, the parts of the device used previously must be replaced with new device parts adapted to the facings of the different shape. This measure is especially time-consuming and burdensome if only small lot sizes of the different jeans of different shapes are to be manufactured, because replacement of the device parts is now necessary at relatively short time intervals. If there is a relative great variability in the angles of the facing seams, the loss of time is accompanied by another drawback, namely, that a corresponding number of folding plates and carrier plates of different designs with pressing plates and folding slides must be kept in stock.

SUMMARY AND OBJECTS OF THE INVENTION

The primary object of the present invention is to provide a folding device for automatic sewing machines, whose device parts coming into contact with the fabric to be folded can be adapted to different shapes of the fabric to be sewn.

According to the invention, a folding device is provided for an automatic sewing machine for folding over at least two edge strips of a first fabric part. The edge strips extend at an angle to one another and the first fabric part will be sewn on a second fabric part. The device includes a support plate for the second fabric part, a folding plate movable in relation to the support plate for the first fabric part, and a carrier plate. The carrier plate is movable in relation to the support plate and the folding plate for a pressing plate that can be placed on the first fabric part. At least two folding slides are provided which are arranged at an angle in relation to one another and which are connected to a drive means each. The folding plate and the pressing plate have at least one edge strip each, whose angle is adjustable, and the angle of at least one of the folding slides is adjustable.

By designing part of the folding plate and of the pressing plate as an edge strip with adjustable angles, these device parts can be adapted to the actual shape of the fabric to be folded, e.g., facings of jeans with two edge strips extending at a defined angle to one another, by setting the angular position of the edge strips. In addition to this, the angle of the folding slide associated with the adjustable edge strip of the pressing plate can be set as well. Thus, the device parts coming into contact with the facings do not need to be replaced with other device parts any longer when changing over from a jeans of one shape to another, but only their geometric or angular orientation needs to be adapted to the shape of the current facing.

Even though an adjusting device for a folding rail on a sewing machine, which is used to prepare tucks extending at an acute angle, has been known from DE 295 14 185 U1, it could not have offered any suggestions to the development of the folding device according to the present invention, because the entire folding rail rather than its individual parts is adjustable in this device, and, moreover, the folding rail is only displaced linearly, but its angle is not adjusted.

The edge strips associated with one another and the corresponding folding slide are preferably pivotable around the axes extending at right angles to the surface of the folding, pressing and carrier plates. The pivot axis of the edge strip of the pressing plate and the pivot axis of the folding slide form a common axis, and they are flush with the pivot axis of the edge strip with the folding plate located in the folding position.

The pivotable folding slide and the associated drive means may be arranged together displaceably in two arc-shaped elongated holes of the carrier plate. The edge strip of the folding plate preferably contains a flat attachment plate, which is arranged in a, correspondingly designed recess of the said folding plate.

Due to the edge strip of the folding plate being connected to a laterally extending bar, whose other end is connected to a clamping or adjusting mechanism, the top side and the underside of the folding plate, which come into contact with the facing, are kept free of the components used to pivot the edge strip and for fixing the pivoted position set, so that these do not hinder the laying on of the facings and the folding over of the edge strips. The clamping mechanism may be an adjusting screw. If it is desired for the edge strip to be adjusted by a servo means, a suitable actuating drive is used, which shall be designed such that it can move the edge strip into the different pivoted positions required and fix them.

Analogous statements can also be made concerning the actuation of the edge strip of the pressing plate, with the only difference that the bar is arranged above the pressing plate in this case, because it causes less disturbance there than on the side of the plate.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
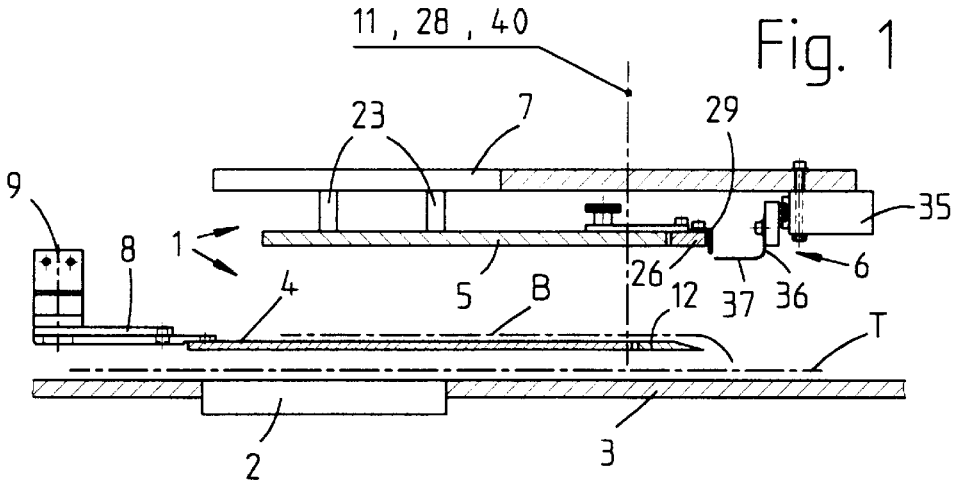
FIG. 1 is a schematic view of the folding device.

Referring to the drawings in particular, the invention comprises a folding device 1 which is arranged above a stationary support table 2 and a vertically movable support plate 3. It comprises essentially a folding plate 4, a pressing plate 5, and a plurality of folding slides 6, wherein the pressing plate 5 and the folding slides 6 are arranged at a common carrier plate 7.

With a holding plate 8, the folding plate 4 is fastened to a carrier 9, which is movable in the horizontal as well as vertical directions by means of drive means, not shown.

The folding plate 4 has a beveled edge section 10 and a beveled edge strip 12 pivotable around a vertical axis 11. The edge strip 12 is connected to a flat attachment plate 13, which engages a flat recess 14 provided on the underside of the folding plate 4. It is achieved as a result that the underside of the folding plate 4 and the underside of the pivotable edge strip 12 are flush with one another.

One end of a bar 15, which bar is guided on two carrier brackets 16 recessed in the folding plate 4 and extends to the side of the folding plate 4, is articulated to the end of the attachment plate 13 located opposite the axis 11. The other end of the bar 15 carries a screw 17. It passes through an elongated hole 18 in a projection 19 provided at the holding plate 8. After loosening the screw 17, it can be moved into another position together with the bar 15 and the edge strip 12, after which this position is secured against a spontaneous change in setting by tightening the screw 17.

Figure 3:
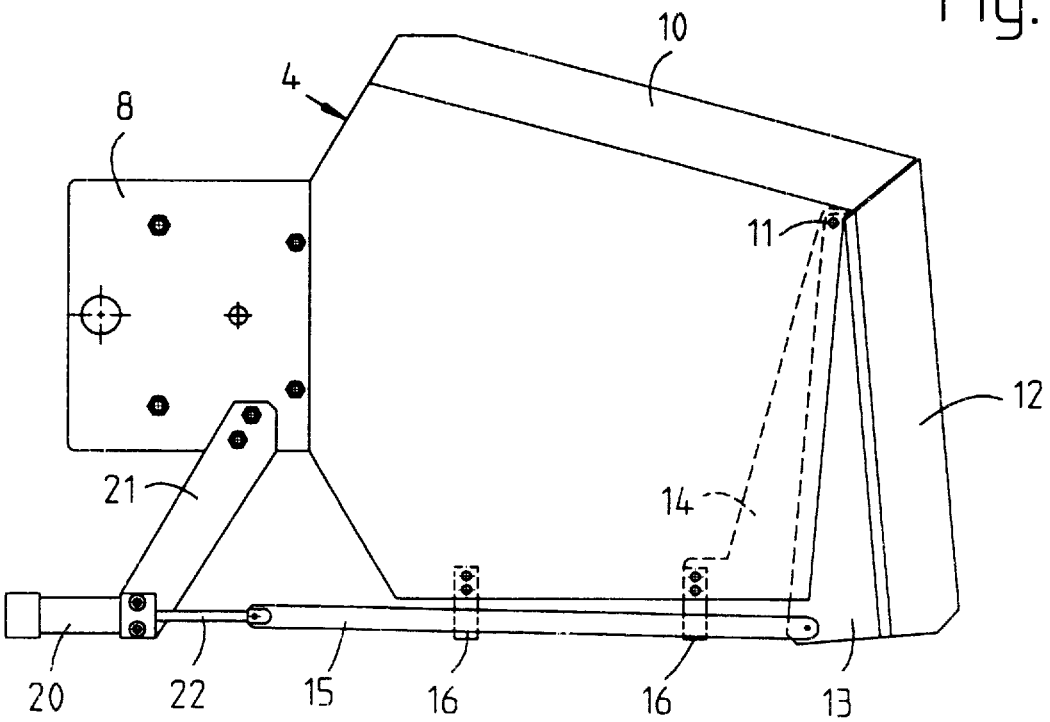
FIG. 3 is a top view of the folding plate in the extended pivoted position of the edge strip in conjunction with an actuating drive.
Figure 4:
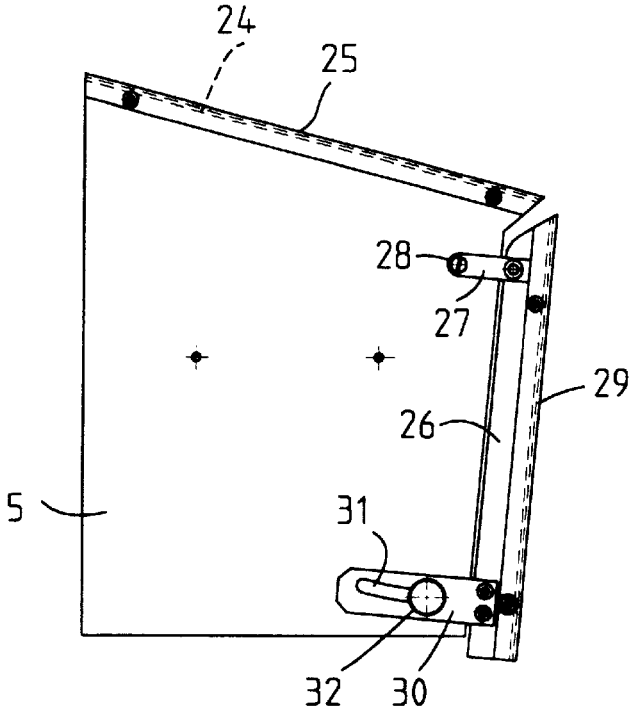
FIG. 4 is a top view of the pressing plate in a withdrawn pivoted position of the edge strip in conjunction with a clamping mechanism.

Instead of a screw 17, a compressed air cylinder 20 is associated with the bar 15 in FIG. 3. This cylinder 20 is fastened to a projection 21 of the holding plate 8, and its piston rod 22 is articulated to the bar 15. By means of the compressed air cylinder 20, the edge strip 12 can be pivoted into two different angular positions and be held in these positions by continuously admitting pressure to the cylinder 20. If the edge strip 12 shall be able to be pivoted into more than two different angular positions, an actuating drive that can be switched to a plurality of stages or operated in a continuously variable manner, e.g., a series-connected arrangement of a plurality of cylinders or a stepping motor, is used instead of a cylinder 20.

The pressing plate 5 is fastened to the carrier plate 7 by means of two spacers 23 at a vertically spaced location. At its edge 24 associated with the edge section 10 of the folding plate 4, the pressing plate 5 carries a folding strip 25 with an L-shaped cross section, whose vertical leg projects over the underside of the pressing plate 5. The pressing plate 5 also has an edge strip 26, which is mounted on the pressing plate 5 by means of a projection 27 fastened to it and is pivotable around an axis 28. The edge strip 26 also carries an L-shaped folding strip 29, whose vertical leg projects over the underside of the pressing plate 5.

The edge strip 26 has a second projection 30 fastened to it, which is provided with an elongated hole 31. A screw 32 accommodated in the pressing plate 5 is passed through the elongated hole 31. After loosening the screw 32, the edge strip 26 can be pivoted into another position, which corresponds in this case to the orientation of the edge strip 12 of the folding plate 4, after which this position is secured by tightening the screw 32.

Figure 5:
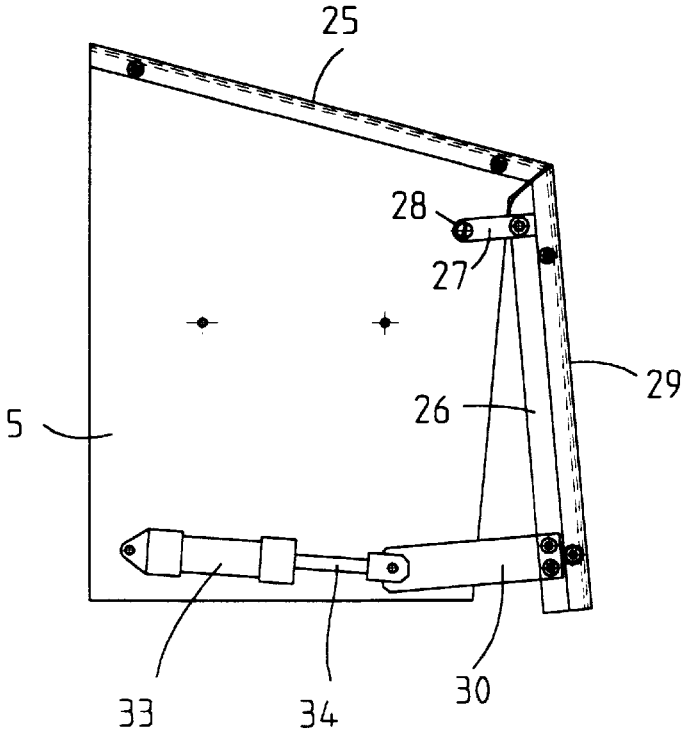
FIG. 5 is a top view of the pressing plate in the extended pivoted position of the edge strip in conjunction with an actuating drive.

Instead of a screw 32, a compressed air cylinder 33 is associated as an actuating drive with the edge strip 26 in FIG. 5, the compressed air cylinder 33 being pivotably mounted on the pressing plate S and its piston rod 34 being articulated to the projection 30. If the edge strip 26 shall be able to be pivoted into more than two angular positions in the same manner as the edge strip 12 of the folding plate 4, an actuating drive that can be switched to a plurality of stages or can be operated in a continuously variable manner is used instead of a cylinder 33, as in the case of the folding plate 4.

Figure 6:
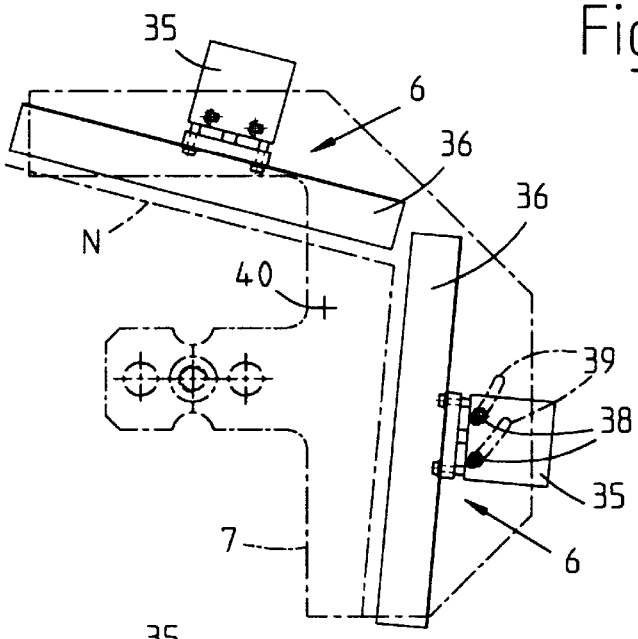
FIG. 6 is a top view of the carrier plate indicated by dash-dotted line and of two folding slides, one of which is in a pivoted-in position.
Figure 7:
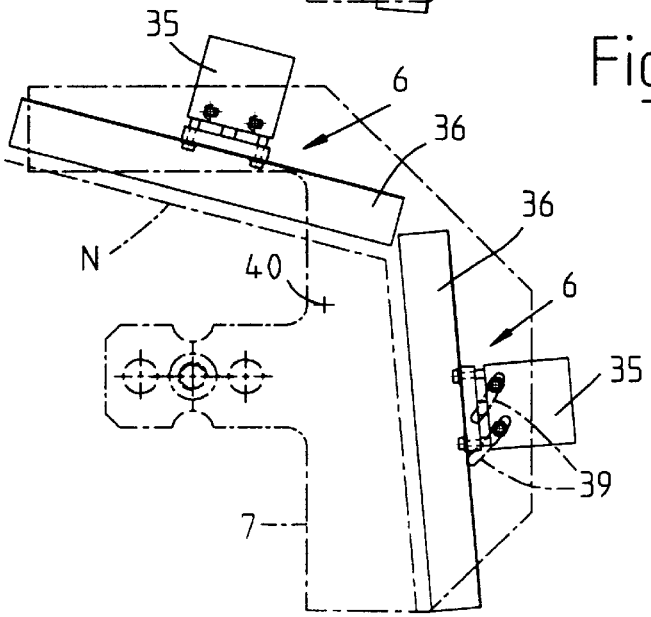
FIG. 7 is a top view corresponding to FIG. 6, wherein one of the folding slides is in the pivoted-out position.
Figure 2:
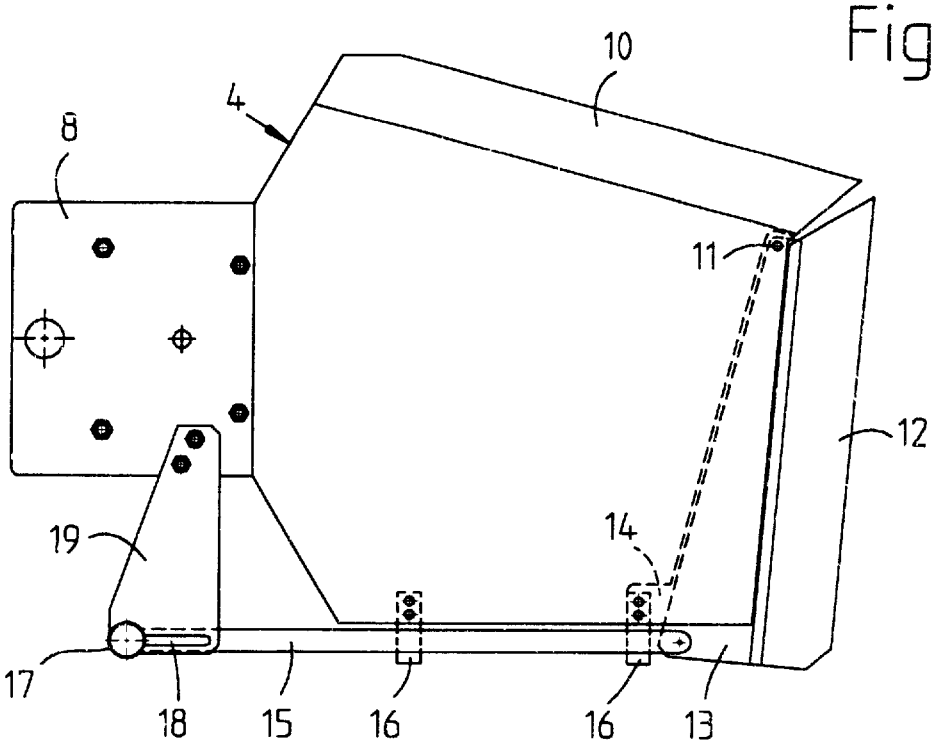
FIG. 2 is a top view of the folding plate in the withdrawn pivoted position of the edge strip in conjunction with a clamping mechanism.

The carrier plate 7 used to accommodate the folding slides 6 is indicated by dash-dotted lines in FIGS. 6 and 7. The folding slides 6 comprise each a compressed air cylinder 35 and an essentially L-shaped folding element 36, whose leg 37 that comes into contact with the fabric extends essentially horizontally. This leg 37 extends at a closely spaced location under the lower edge of the folding strips 25, 29.

A first folding slide 6, which corresponds to the folding strip 25 or the edge section 10 of the folding plate 4 in terms of its arrangement and angular position, is rigidly arranged at the carrier plate 7. A second folding slide 6 is adjustably arranged at the carrier plate 7. The two fastening screws 38 are guided for this purpose in an elongated hole 39 of an arc-shaped design each. The two elongated holes 39 have a common radius point 40, which is flush with the axis 28 of the edge strip 26. After loosening the screws 38, the corresponding folding slide 6 can be pushed into another position. Due to the arc shape of the elongated holes 39, the folding slide 6 is pivoted around the common radius point 40 as the axis. It should be ensured that the new angular position of the folding slide 6 corresponds to the actual orientation of the edge strip 26 and that of the edge strip 12.

The axis 11 and the axis 28 or the radius point 40 are flush in the folding position of the folding plate 4 shown in FIG. 1. It is guaranteed as a result that the mutual association and orientation are preserved during the adjustment of the edge strips 12 and 26 as well as of the movable folding slide 6 by the same angles.

According to FIG. 1, the pocket bag T, represented by dash-dotted line, is laid on the support plate 3, which is flush with the support table 2 at that point in time. The facing B is then placed on the folding plate 4 floating above the support plate 3 at a space location.

After laying on the fabric parts T and B, the folding plate 4 is lowered onto the pocket bag T, and the support plate 3 is also moved downward at the same time. As a consequence, the pocket bag T is clamped between the folding plate 4 and the support table 2, and a free space is created at the same time under the edge areas of the folding plate 4.

The carrier plate 7 is also lowered at the same time to the extent that the pressing plate 5 presses the facing B against the folding plate 4 located in its lower position, and thus fixes it. Before this, the folding strips 25, 29 will have come into contact with the edge sections of the facing B projecting over the edge section 10 and the edge strip 12 and will have bent these downward.

After the facing B has been clamped between the folding plate 4 and its edge strip 12, on the one hand, and the pressing plate 5 and its edge strip 26, on the other hand, pressure is admitted to the compressed air cylinders 35, and the folding elements 36 of the folding slides 6 are thus extended, and the prefolded edge sections of the facing B are folded over to the underside of the folding plate 4 and of the edge strip 12 as a result. The support plate 3 is then again raised into the upper position, as a result of which the folding elements 36 of the folding slides 6 are pressed against the folded-over edge sections of the facing B. The folding elements 36 are then withdrawn into their starting position. The folded-over edge sections of the facing B now remain clamped between the support plate 3 and the folding plate 4. After the folding elements 36 are pulled out, the carrier plate 7 with the pressing plate 5 is raised to the extent that a sewing template, not shown, can be moved over the facing B and lowered. As soon as the folding plate 4 has been pulled out of the folded facing B to the side, the sewing template transports the two fabric parts B and T placed one on the another to a sewing machine, which will then form the angular seam N indicated by a dash-dotted line in FIGS. 6 and 7.

While specific embodiments of the invention have been shown and described in detail to illustrate the application of the principles of the invention, it will be understood that the invention may be embodied otherwise without departing from such principles.

What is claimed is:

1. A folding device for an automatic sewing machine for folding over at least two edge strips of a first fabric part, wherein the edge strips extend at an angle to one another and the first fabric part is sewn on a said second fabric part, the device comprising:

a support plate for the second fabric part;

a folding plate movable in relation to said support plate for said first fabric part;

a carrier plate movable in relation to said support plate and said folding plate;

a pressing plate that can be placed on said first fabric part; and at least two folding slides, which are arranged at an angle in relation to one another and which are each connected to a drive means, said folding plate and said pressing plate having at least one edge strip defining an angle which is adjustable, and an angle of at least one of said folding slides is adjustable.

2. The folding device in accordance with claim 1, wherein said edge strips associated with one another and the said corresponding folding slide are pivotable around axes extending at right angles to a surface of said folding plate, said pressing plate and said carrier plate, wherein said pivot axis of said edge strip of said pressing plate and said pivot axis of said folding slide form a common axis, and they are flush with said pivot axis of said edge strip with said folding plate located in a folding position.

3. The folding device in accordance with claim 2, wherein said pivotable folding slide and said associated drive means are arranged together displaceably in two arc-shaped elongated holes of said carrier plate.

4. The folding device in accordance with claim 2, wherein said edge strip of said folding plate contains a flat attachment plate, which is arranged in a, correspondingly designed recess of said folding plate.

5. The folding device in accordance with claim 3, wherein said edge strip of said folding plate contains a flat attachment plate, which is arranged in a, correspondingly designed recess of said folding plate.

6. The folding device in accordance with claim 2, wherein said edge strip of said folding plate is connected to an end of said bar, which extends to a side of said folding plate, and another end of said bar is connected to one of a clamping mechanism and an actuating drive.

7. The folding device in accordance with one claim 2, wherein said edge strip of said pressing plate is connected to one of a clamping mechanism and an actuating drive.

* * * * *